US005175887A

United States Patent [19]

Kim

[11] Patent Number: 5,175,887

[45] Date of Patent: Jan. 5, 1993

[54] ABSORBENT HEADBAND

[76] Inventor: Daniel S. Y. Kim, 215 DuBois Ct., Vancouver, Wash. 98661

[21] Appl. No.: 811,311

[22] Filed: Dec. 20, 1991

[51] Int. Cl.[5] ..... A42C 5/02

[52] U.S. Cl. ..... 2/174; 2/207; 2/DIG. 11

[58] Field of Search ..... 2/174, 181, 181.2, 181.6, 2/198, 207, DIG. 11

[56] References Cited

U.S. PATENT DOCUMENTS

| | | | |
|---|---|---|---|
| 2,016,210 | 10/1935 | Mann | 2/171 |
| 2,640,198 | 6/1953 | Mullen | 2/174 |
| 3,050,071 | 8/1962 | Hall | 2/174 |
| 3,211,160 | 10/1965 | Miller | 2/198 |
| 3,419,909 | 1/1969 | Spain | 2/174 |
| 3,471,867 | 10/1969 | Kirchhoff | 2/207 |
| 3,529,308 | 9/1970 | McBride | 2/174 |
| 3,668,707 | 6/1972 | Williams | 2/207 |
| 3,828,366 | 8/1974 | Conrad | 2/174 |
| 4,428,079 | 1/1984 | McKee | 2/174 |
| 4,742,581 | 5/1988 | Rosenthal | 2/181 |
| 4,941,210 | 7/1990 | Konucik | 2/DIG. 11 |
| 4,947,488 | 8/1990 | Ashinoff | 2/DIG. 11 |

OTHER PUBLICATIONS

McCall's Crafts pattern number 882/3461.

*Primary Examiner*—Andrew M. Falik
*Assistant Examiner*—Diana L. Biefeld
*Attorney, Agent, or Firm*—Marger, Johnson, McCollom & Stolowitz

[57] ABSTRACT

An absorbent headband is provided which includes a resilient inner frame and one or more absorbent outer covers. The outer cover is generally tubular, and closed at each end. The outer cover is provided with a slot for removably inserting the inner frame member into the interior of the outer cover. A method is provided for absorbing perspiration which includes the steps of providing a resilient inner member which is generally u-shaped, providing a tubular outer cover, inserting the inner member into the outer cover, and placing the headband on the head of the wearer. The method may also include the steps of removing the inner member from the outer cover and inserting it into a second outer cover which may be dry, or of a different color as desired.

9 Claims, 1 Drawing Sheet

ABSORBENT HEADBAND

The present invention relates to absorbent headbands.

BACKGROUND OF THE INVENTION

Absorbent headbands are generally well-known. A person may become overheated and perspire while participating in strenuous activities. Perspiration from the head, if unchecked, often drains into a person's eyes and interferes with their vision. The visual interference is a minor annoyance in some cases, and a serious hazard in others. It is therefore common for a person to wear an absorbent headband while participating in strenuous activities to absorb moisture from their head, and particularly from the front and sides of their head. Numerous headband designs have been introduced to address this general problem.

For example, U.S. Pat. No. 4,742,581 to Rosenthal discloses a sweatband for cooling the head or wrist. The '581 sweatband comprises a conductive, non-absorbent inner layer bonded to an absorbent outer layer, and a band for extending around the rear of the wearer's head to secure the sweatband in place. The outer layer is first immersed in water, and the sweatband is then placed on the wearer's head and contacts the wearer's head clear around. Heat from the wearer's head is then conducted by the inner layer to the outer layer to evaporate the water and cool the wearer's head. Any perspiration reaching the sweatband is absorbed by the outer layer and evaporated in a like manner.

U.S. Pat. No. 2,016,210 to Mann discloses a sweatband comprising small pads of absorbent material strung on a flexible wire. An eyelet is formed in one end of the wire, and a hook in the other. A flexible headstrap is attached at one end to the eyelet in the wire, while the opposite end of the headstrap is formed into a loop for engaging the hooked end of the flexible wire. The sweatband is worn by placing the absorbent pads against the forehead, extending the headstrap around the back of the head and hooking its free end to the loop of the flexible wire.

U.S. Pat. No. 4,941,210 to Konucik discloses a sweat pad for attaching to the existing sweat band of a hat or garment to supplement the perspiration absorbing capacity of the hat or garment. Additionally, the sweat pads can be readily interchanged for replacement and washing.

U.S. Pat. No. 3,419,909 to Spain discloses an eyeshield for use in hair tinting which comprises a brow member, a nose rest which rests on the wearer's nose, and side pieces extending rearwardly from each end of the browpiece, and terminating short of the wearer's ears. Attached to the rear of the brow member is an absorbent material to intercept hair tinting materials before reaching the wearer's eyes. A friction material is attached the inner sides of the side pieces to hold the brow member in place.

U.S. Pat. No. 2,640,198 to Mullen discloses a protector for use in protecting the wearer's skin when applying liquids to the hair. The '198 protector comprises a formable, non-resilient core member disposed within an elongated strip of absorbent material. The core member is shaped to conform to the hairline of the wearer across the forehead, and then to follow the hairline around the ears in order to hold the protector in place.

The headbands and protectors discussed above do not meet several needs of a person in using an absorbent headband. For example, none of the above sweatbands provide a single absorbent headband which can be worn during strenuous activity without unduly ruffling a hairstyle, and which at the same time allows the user to readily remove a perspiration-wetted outer cover for washing or replacement. The wearer may desire to replace the sweatband outer cover with a similar dry one, or may wish to replace it with one of a different color or graphic design to complement particular athletic wear. A need therefore remains for an absorbent sweatband which is wearable by a user during strenuous activity, without the headband unduly ruffling the wearer's hair, and which also allows the wearer to replace the outer cover when desired.

SUMMARY

An absorbent headband consists of a resilient inner member disposed within a tubular outer cover to form an absorbent headband. The inner member may be generally horseshoe-shaped, and has side portions of a sufficient length to extend rearward along the sides of the wearer's head to an area generally above the ears of the wearer. The ends of the side portions bear against the sides of the wearer's head to secure the headband in place during use. The inner member is removable from the outer cover through a slot in the outer cover so that a second outer cover may replace the first which has become wetted, or to replace the first outer cover with an outer cover of a different color or pattern as desired.

A method is provided for absorbing perspiration from a person's head which includes the steps of providing a resilient inner frame member, providing a first tubular, absorbent, outer cover for removably enclosing the inner frame member, inserting the inner frame member into the outer cover to form an absorbent headband, placing the headband on the wearer's head so that its end portions bear against opposing sides of the wearer's head to position the headband for absorbing perspiration from a wearer's head. The method may include providing an inner member formed from a polymeric material, and which may be generally horseshoe-shaped.

The method may include the steps of removing the inner frame member from the first outer, washing the first outer cover, and replacing the inner member into the first outer cover.

The method may further include the steps of providing a second tubular, absorbent, outer cover for removably enclosing the inner frame member of like or different color or pattern, removing the inner frame member from the first outer cover, and inserting the inner frame member into the second outer cover through a slot near its end.

DETAILED DESCRIPTION OF THE PREFERRED EMBODIMENT

Figure 1:
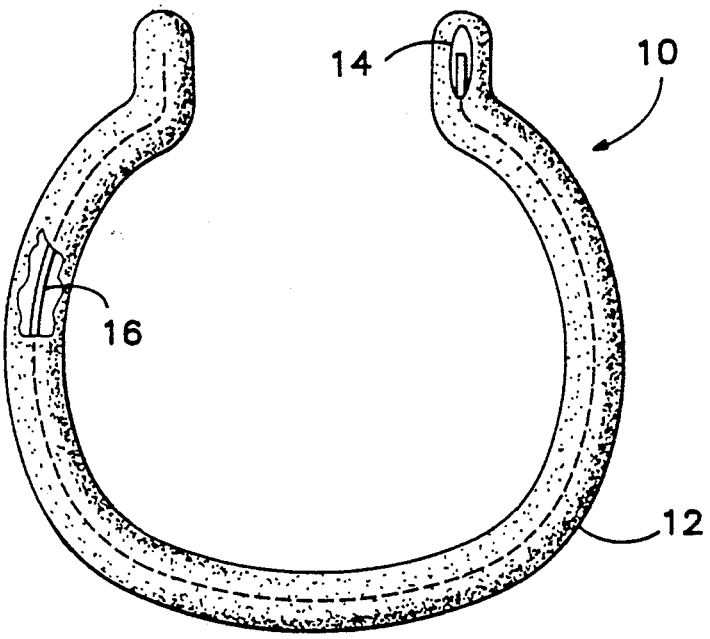
FIG. 1 is a plan view of an absorbent headband according to the present invention.

Referring now to FIG. 1, as absorbent headband according to the present invention is shown generally at 10. Headband 10 includes an absorbent outer cover 12. An inner member 16 is disposed within outer cover 12. Outer cover 12 is generally tube-shaped and closed on each end. Near one end, slot 14 is formed therein to permit the insertion of inner member 16 into outer cover 12.

Figure 2:
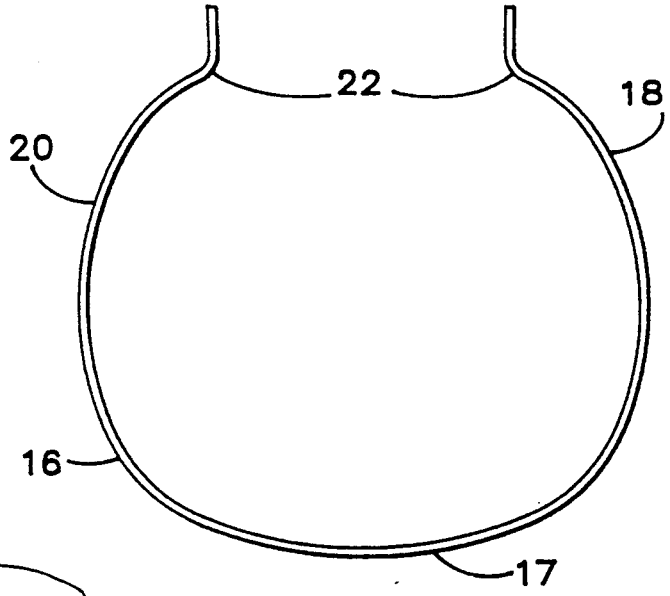
FIG. 2 is a plan view of the resilient inner member.
Figure 3:
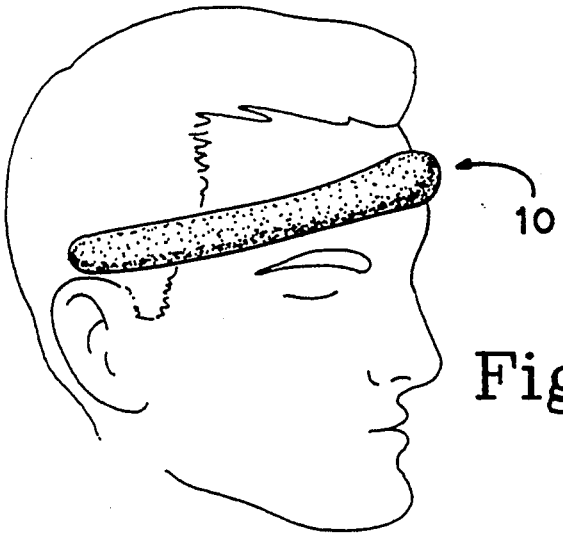
FIG. 3 is a perspective view of an absorbent headband in place on the head of a wearer.

Referring to FIG. 2, inner member 16 is generally horseshoe-shaped with a center portion 17, and end portions 18 and 20. Inner member is formed from a resilient material, preferably a resilient polymeric material. End portions 18 and 20 are of a sufficient length to extend backward along the sides of a wearer's head to terminate at a position generally above the ears of the wearer, as best seen in FIG. 3. End portions 18 and 20 are curved so that they are positioned away from the sides of the wearer's head except for a contact point 22 which bear against the wearer's head to secure the headband in place. Center portion 17 rests against the wearer's forehead to absorb perspiration, and to prevent it from reaching the wearer's eyes.

Preferably, a wearer will have several interchangeable outer covers 12. When one is wetted from use and will absorb no more moisture, the wearer can remove the headband 10, remove inner member 16 from outer cover 12 through slot 14, and insert inner member into a dry outer cover 12. Alternatively, various outer covers 12 could be colored or patterned to complement various clothes of the wearer, and in that way headband 10 could be adapted to present a stylish appearance with various clothes without the necessity of having multiple headbands. The outer cover 12 may be washed and then re-used.

Those skilled in the art will recognize that numerous modifications and changes may be made to the preferred embodiment without departing from the scope of the claimed invention.

I claim:

1. An absorbent headband comprising:

first and second ends and a center portion;

a resilient generally horseshoe shaped inner frame member having opposed first and second ends for urging said first and second headband ends against opposing sides of a wearer's head at positions rearward of the wearer's temples and above the wearer's ears with sufficient force to secure said absorbent headband on the wearer's head during strenuous activities, and having a center portion for positioning said center portion of said absorbent headband against the wearer's forehead proximate to and above the wearer's eyebrows;

a tubular, absorbent, outer cover having first and second end portions and a center portion, said outer cover including means for receiving said inner frame member within its tubular surfaces; and wherein the forehead of the wearer is contacted directly by the absorbent cover.

2. An absorbent headband according to claim 1 further comprising:

means for removably receiving said inner frame member within said outer cover; and said inner frame member being removably located within said outer cover.

3. An absorbent headband according to claim 1 wherein said means for removably locating said inner frame member within said outer cover includes said an opening formed in said outer cover for removably inserting said inner frame member into said outer cover.

4. An absorbent headband according to claim 1 wherein said inner frame member is formed from a polymeric material.

5. An absorbent headband according to claim 1 wherein said outer cover is made of a washable material.

6. An absorbent headband in combination with a plurality of tubular absorbent outer covers comprising:

first and second ends and a center portion:

a resilient generally horseshoe shaped inner frame member having opposed first and second ends for urging said first and second headband ends against opposing sides of a wearer's head at positions rearward of the wearer's temples and above the wearer's ears with sufficient force to secure said absorbent headband on the wearer's head during strenuous activities, and having a center portion for positioning said center portion of said absorbent headband against the wearer's forehead proximate to and above the wearer's eyebrows;

one of said outer covers having first and second end portions and a center portion, said outer cover including means for receiving said inner frame member within its inside surfaces; and wherein the skin of the wearer is contacted by a surface of the outer cover and; said plurality of covers being of like color and pattern.

7. An absorbent headband in combination with a plurality of tubular absorbent outer covers comprising:

first and second ends and a center portion:

a resilient generally horseshoe shaped inner frame member having opposed first and second ends for urging said first and second headband ends against opposing sides of a wearer's head at positions rearward of the wearer's temples and above the wearer's ears with sufficient force to secure said absorbent headband on the wearer's head during strenous activities, and having a center portion for positioning said center portion of said absorbent headband against the wearer's forehead proximate to and above the wearer's eyebrows;

one of said outer covers having first and second end portions and a center portion, said outer cover including means for receiving said inner frame member within its inside surfaces; and wherein the skin of the wearer is contacted by a surface of the outer cover and; said plurality of covers being of like color and patterns.

8. A method of absorbing perspiration from a person's head comprising the steps of:

providing a resilient inner frame member having opposed first and second end portions for urging said first and second headband end portions against opposing sides of a wearer's head for securing said absorbent headband in place on the wearer's head;

providing a first tubular, absorbent, outer cover for removably receiving said inner frame member within;

inserting said inner frame member into said first outer cover to form an absorbent headband; and placing said headband on the wearer's head so that said opposing first and second end portions bear against opposing sides of the wearer's head at positions rearward of the wearer's temples and above the wearer's ears with sufficient force to secure said absorbent headband on the wearer's head during strenuous activities, and so that a center cover portion of said absorbent headband rests against the wearer's forehead proximate to and above the wearer's eyebrows to position said absorbent headband for absorbing perspiration from a wearer's forehead.

9. The method of claim 8 which further comprises the steps of:

providing a second tubular, absorbent, outer cover for removably receiving said inner frame member within;

removing said inner frame member from said first outer cover; and inserting said inner frame member into said second outer cover.

* * * * *